US009587637B2

(12) United States Patent
Van Heck

(10) Patent No.: US 9,587,637 B2
(45) Date of Patent: Mar. 7, 2017

(54) PUMP, PUMP SYSTEM AND METHOD FOR PUMPING A MEDIUM

(75) Inventor: Jeroen Gerardus Maria Van Heck, Noordwolde (NL)

(73) Assignee: J.G.M. van Heck Beheer B.V., Noordwolde (NL)

( * ) Notice: Subject to any disclaimer, the term of this patent is extended or adjusted under 35 U.S.C. 154(b) by 17 days.

(21) Appl. No.: 14/118,753

(22) PCT Filed: May 21, 2012

(86) PCT No.: PCT/NL2012/050354
§ 371 (c)(1),
(2), (4) Date: Feb. 27, 2014

(87) PCT Pub. No.: WO2012/161574
PCT Pub. Date: Nov. 29, 2012

(65) Prior Publication Data

US 2014/0178238 A1 Jun. 26, 2014

(30) Foreign Application Priority Data

May 20, 2011 (NL) ..... 2006827
Aug. 25, 2011 (NL) ..... 2007299

(51) Int. Cl.

| | |
|---|---|
| ***F03C 4/00*** | (2006.01) |
| ***F04C 2/00*** | (2006.01) |
| ***F04C 18/00*** | (2006.01) |
| ***F04C 2/16*** | (2006.01) |
| ***F04C 18/16*** | (2006.01) |
| ***B67D 7/68*** | (2010.01) |
| ***F04C 13/00*** | (2006.01) |

(Continued)

(52) U.S. Cl.
CPC ..... *F04C 2/16* (2013.01); *B67D 7/68* (2013.01); *B67D 9/00* (2013.01); *F04C 2/165* (2013.01); *F04C 13/008* (2013.01); *F04C 15/0034* (2013.01); *F04C 18/165* (2013.01); *B63B 27/24* (2013.01); *F04C 15/008* (2013.01); *F04C 2240/20* (2013.01)

(58) Field of Classification Search
CPC ..... F04C 2/165; F04C 18/18; F04C 18/165; F04C 13/008; F04C 15/0034; F04C 2240/20; B63B 27/24; B67D 7/68; B67D 9/00
USPC ..... 418/196–197, 201.1
See application file for complete search history.

(56) References Cited

U.S. PATENT DOCUMENTS 872,040 A * 11/1907 Anderson et al. ..... F04C 2/14 418/196
5,617,757 A * 4/1997 Horner ..... G01F 23/00 269/153
2011/0033176 A1* 2/2011 Garvey ..... A47J 27/21166 392/444

FOREIGN PATENT DOCUMENTS

AT 12445 U1 5/2012
CN 201129297 Y * 10/2008 ..... F04C 2/16

(Continued)

OTHER PUBLICATIONS

Office Action from the Chinese Patent Office dated Mar. 17, 2016.

*Primary Examiner* — Theresa Trieu
(74) *Attorney, Agent, or Firm* — The Webb Law Firm

(57) ABSTRACT

The invention relates to a pump, a pump system and a method for pumping a medium. The pump for pumping medium comprises an inlet, an outlet, a drivable spindle and (Continued)

at least two follower spindles, wherein the drivable spindle and the at least two follower spindles are provided at a mutual angle to each other.

14 Claims, 11 Drawing Sheets

(51) Int. Cl.

| | |
|---|---|
| ***B67D 9/00*** | (2010.01) |
| *B63B 27/24* | (2006.01) |
| *F04C 15/00* | (2006.01) |

(56) References Cited

FOREIGN PATENT DOCUMENTS

| | | | |
|---|---|---|---|
| CN | 101865128 | A | 4/2009 |
| DE | 2303478 | | 8/1974 |
| DE | 102009051443 | A1 | 5/2011 |
| EP | 0323834 | A2 | 7/1989 |
| EP | 1925822 | A1 | 5/2008 |
| GB | 954426 | | 4/1964 |
| WO | 2012058702 | A2 | 5/2012 |

* cited by examiner

PUMP, PUMP SYSTEM AND METHOD FOR PUMPING A MEDIUM

CROSS-REFERENCE TO RELATED APPLICATIONS

This application is the United States national phase of International Application No. PCT/NL2012/050354 filed May 21, 2012 and claims priority to The Netherlands Patent Application Nos. 2006827 and 2007299 filed May 20, 2011 and Aug. 25, 2011, respectively, the disclosures of which are hereby incorporated by reference in their entirety.

BACKGROUND OF THE INVENTION

Field of the Invention

The present invention relates to a pump, and more particularly a pump suitable for pumping fuel, oil and crude from (stranded) ships and cargo spaces.

Description of Related Art

Pumps are known in practice which are suitable for pumping medium such as fuel. A problem with these pumps is usually that they are found to be unable to pump a determined flow rate over a sufficiently great operating range irrespective of the viscosity of the medium.

In the case a medium is pumped from a stranded ship and/or a cargo space, limited space is usually available. Known in practice for instance are double-walled ships wherein fuel tanks are provided between the walls. These fuel tanks are provided with a fuel conduit in the direction of the engines of the ship and usually also with a connection suitable for measurement of the fuel level and a ventilation connection. These fuel tanks are found to be susceptible to leakage when calamities occur, whereby environmental pollution and other problems can be caused in such cases.

The present invention has for its object to provide a pump which obviates or at least reduces the above stated problems.

SUMMARY OF THE INVENTION

This object is achieved with the pump for pumping a medium according to the invention, comprising an inlet, an outlet, a drivable spindle and at least two follower spindles, wherein the drivable spindle and the at least two follower spindles are provided at a mutual angle to each other.

As seen in cross-section, the imaginary line from the centre of a first follower spindle to the centre of the drivable spindle/shaft for instance forms an angle with the imaginary line from the centre of a second follower spindle to the centre of the drivable spindle.

A quantity of medium can be pumped by providing a pump with a drivable spindle and two or more non-driven/follower spindles. This is a so-called screw spindle pump. Providing the shafts at an angle, i.e. not providing them in one line, achieves that the dimensions of the pump housing can remain limited. This for instance makes it possible to introduce the pump into a liquid conduit, particularly a monitoring or ventilation pipe, while at the same time a relatively high pump capacity can be realized. This enables use in a so-called submersible oil recovery pump (SORP) application. Such an application is for instance relevant when fuel such as heavy oil has to be pumped out of a fuel tank, for instance in the intermediate space in a double-walled ship. This occurs for instance in the case of a calamity such as a stranded ship. Using the pump according to the invention damage to the area surrounding the stranded ship can in this way be avoided, or in any case reduced.

The drivable spindle/shaft and the at least two follower spindles are preferably provided in a visually asymmetrical configuration. The drivable spindle and the at least two follower spindles are preferably provided here particularly in an asymmetrical force configuration. Surprisingly, this achieves a good balance between pump capacity and pump dimensions which has been found particularly suitable in for instance a SORP application and other similar applications. Damage to for instance the area surrounding a stranded ship caused by leakage of fuel can hereby be avoided or in any case reduced in a relatively short time.

The drivable spindle/shaft and the at least two follower spindles are for instance provided relative to each other such that the centre of gravity of the assembly of the drivable spindle/shaft and the follower spindles is located outside the centre of the drivable spindle/shaft.

In an advantageous preferred embodiment according to the invention the inlet and the outlet are provided in longitudinal direction of the pump.

By providing the inlet and the outlet in longitudinal direction of the pump, particularly the inlet on the front side or nose side of the pump and the outlet on the rear side of the pump, a liquid can be drawn in via the inlet and discharged via the outlet in effective manner while the pump is situated in a relatively narrow space, such as a pipe or conduit. It is hereby possible to dispense with providing connections on the side, or periphery, of the pump. This configuration is for instance advantageous when oil has to be pumped out of a tank system of a stranded seagoing vessel in order to avoid environmental problems. It has been found that a pump can be effectively deployed here with an outer diameter in the range of 100-300 mm, preferably 100-200 mm and most preferably about 150 mm. Owing to the specific configuration of the pump it is hereby possible to work in effective manner in narrow spaces, for instance for the purpose of pumping fuel out of a stranded ship. This reduces the chance of environmental disaster and enables safer and cleaner salvage operations.

In an advantageous preferred embodiment according to the invention the pump comprises an inner pipe seal.

Providing an inner pipe seal makes it possible for the pump to be introduced into a pipe which is not wholly liquid-tight for the purpose of transfer pumping of a medium such as fuel. The inner pipe is preferably of a plastic such that it can be made to length on site in relatively simple manner. Leakage during pumping with the pump according to the invention is substantially avoided due to the inner pipe.

The plastic preferably unfolds during use. The inner pipe is preferably connected releasably to the pump.

It is noted that it is also possible according to the invention to provide the inner pipe seal separately, i.e. without pump or with an alternative pump.

It has been found that the inner pipe seal can be applied particularly advantageously in combination with providing the inlet and outlet in longitudinal direction of the pump. It is hereby possible to utilize the pump according to the invention in narrow and not wholly liquid-tight spaces, particularly pipes and conduits of for instance a fuel system of a cargo vessel. The inner pipe seal can be utilized particularly advantageously when damage has been caused to a cargo vessel, whereby existing pipes and conduits are no longer wholly liquid-tight.

In an advantageous preferred embodiment according to the invention the at least two follower spindles are provided with a smaller diameter than the drivable spindle.

By making use of different diameters for the follower spindles relative to the drivable spindle the diameter of the pump according to the invention can be further limited while achieving substantially similar pump performance. This further increases the utility of the pump, particularly in narrow spaces.

The present invention also relates to a pump system provided with a pump as described above.

Such a pump system provides the same effects and advantages as described for the pump. In an advantageous embodiment the pump system is provided with a T-piece for lowering the pump into a pipe. Openings are preferably provided for passage of hydraulic hoses and the pumped medium.

The invention further also relates to a method for pumping a medium, comprising of providing a pump and/or pump system as described above.

Such a method provides the same advantages and effects as described for the pump and/or pump system. In a preferred embodiment the method according to the invention further comprises of positioning the pump and/or the pump system in a space of a ship and pumping medium out of the ship. The pump according to the invention is preferably used here to pump for instance fuel out of a stranded ship, wherein the pump according to the invention has to be carried through, or even positioned in, narrow spaces such as pipes and conduits. Use can advantageously be made here of the specific configuration of the inlet on the front side and the outlet on the rear side of the pump.

BRIEF DESCRIPTION OF THE DRAWINGS

Further advantages, features and details of the invention are elucidated on the basis of a preferred embodiment thereof, wherein reference is made to the accompanying figures, in which.

DESCRIPTION OF THE INVENTION

Figure 1:
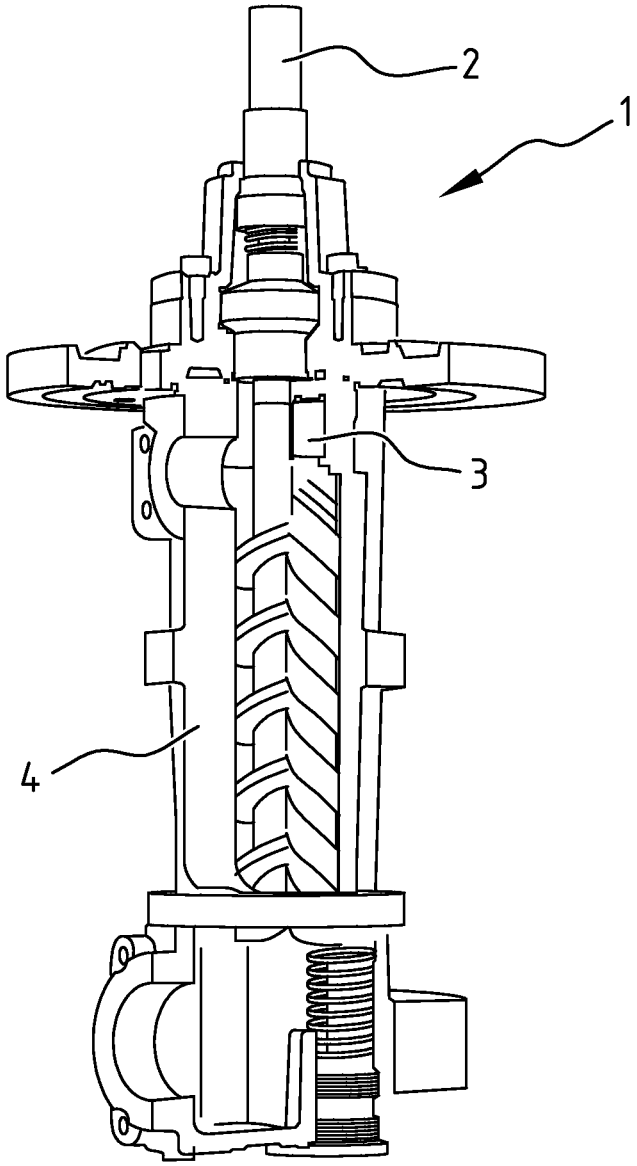
FIG. 1 PRIOR ART
FIG. 1 shows a cross-section of a conventional spindle pump according to the invention.
Figure 2A:
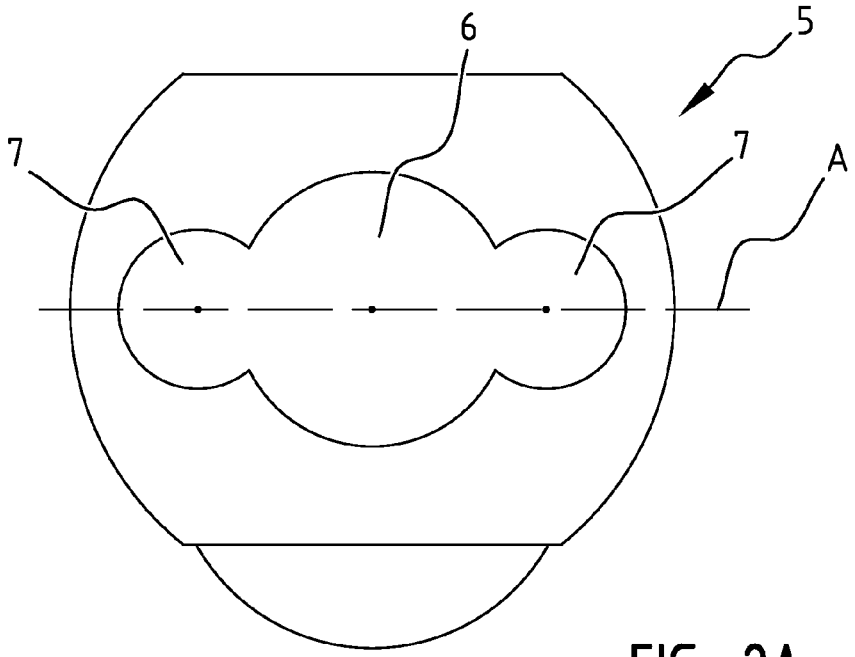
FIG. 2A PRIOR ART
FIG. 2A shows a cross-section of a conventional spindle pump.

A pump 1 (FIG. 1) is provided with a central drive shaft/drive spindle 2 and two non-driven shafts/follower spindles 3. Spindles 2, 3 are arranged in a housing 4. In a conventional pump 5 (FIG. 2A) drive shaft 6 and spindle shafts 7 lie in one line A and are here both visually symmetrical and force-symmetrical.

Figure 2B:
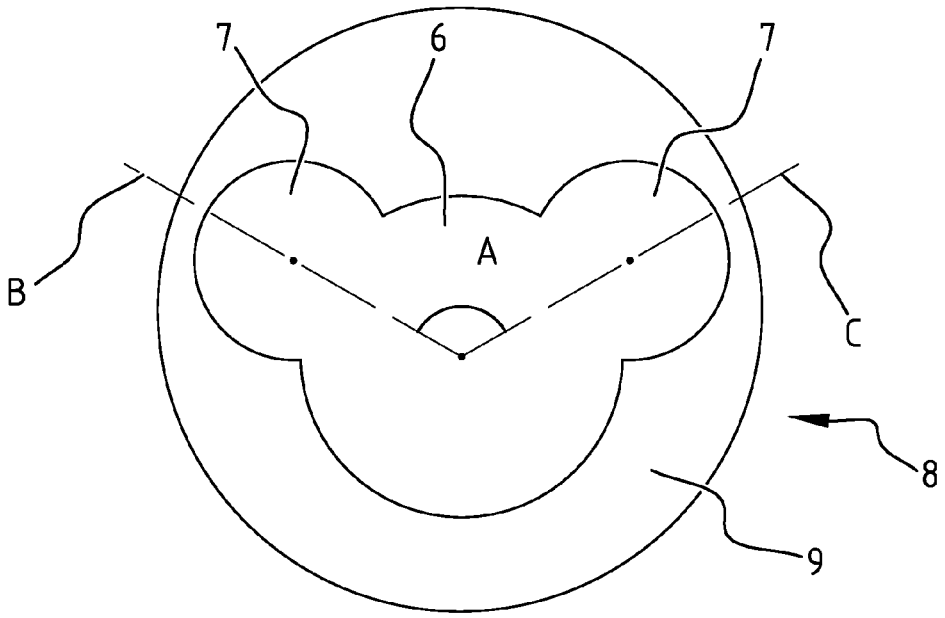
FIG. 2B shows a cross-section of the pump according to the invention.

In pump 8 according to the invention (FIG. 2B) drive shaft 6 and the two spindle shafts 7 do not lie in one line and are here asymmetrical from both a visual and a force viewpoint. The centre line B connecting the centres of the first follower spindle and drive shaft 6 lies at an angle z to centre line C connecting the centres of the second follower spindle and drive shaft 6. It will be apparent that, with the same dimensions, housing 9 of pump 8 can be smaller than that of a conventional pump 5. Because of this arrangement, the pump 8 may be introduced into a liquid conduit, such as a monitoring pipe or ventilation pipe.

In the shown embodiment the diameter of spindle 7 is smaller than the diameter of drive shaft 6.

Figure 3:
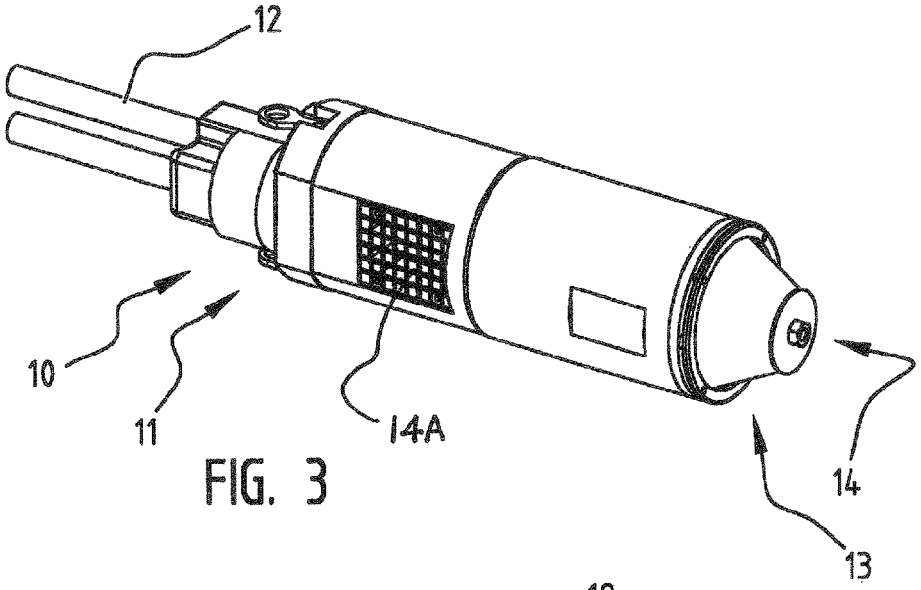
FIGS. 3 and 4 show views of the pump of FIG. 2B.
Figure 4:
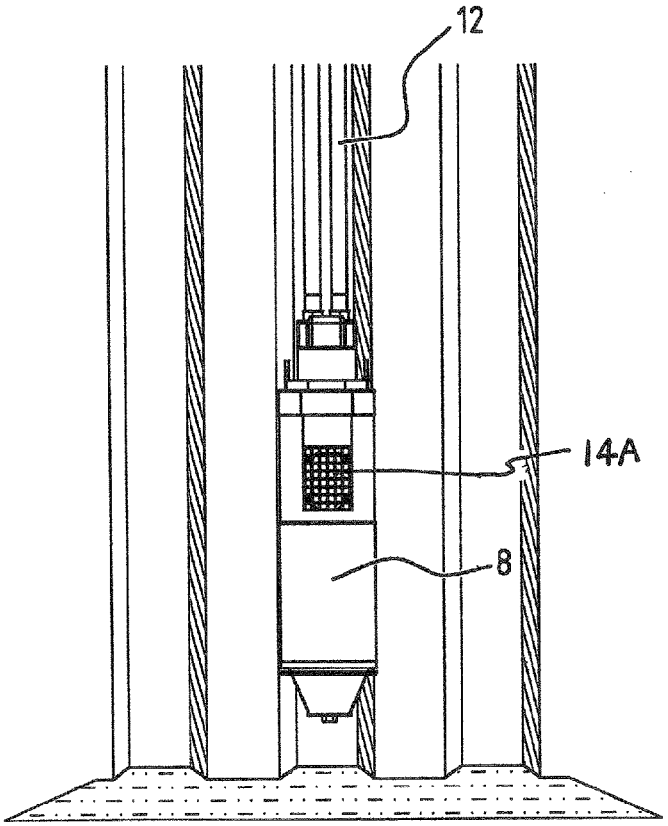

Pump 8 (FIGS. 3 and 4) is provided on rear side 11 with a motor 10. In the shown embodiment motor 10 is driven hydraulically using hydraulic hoses 12. In the shown embodiment the length of pump 8 is about 613 mm, the diameter about 150 mm, and the weight amounts to about 50-60 kg. Situated on front side 13 is an inlet 14 through which fuel can be suctioned and discharged through outlet 14A. Pump 8 (FIG. 4) is embodied such that a pump capacity of about 70 mVhour is possible at a pressure of about 3 bar and a viscosity of about 100 cSt at about 30° C. The hydraulic specifications here are a maximum pressure of 210 bar and a maximum flow between 54 and 63 l/min, depending on the type of motor.

Figure 5:
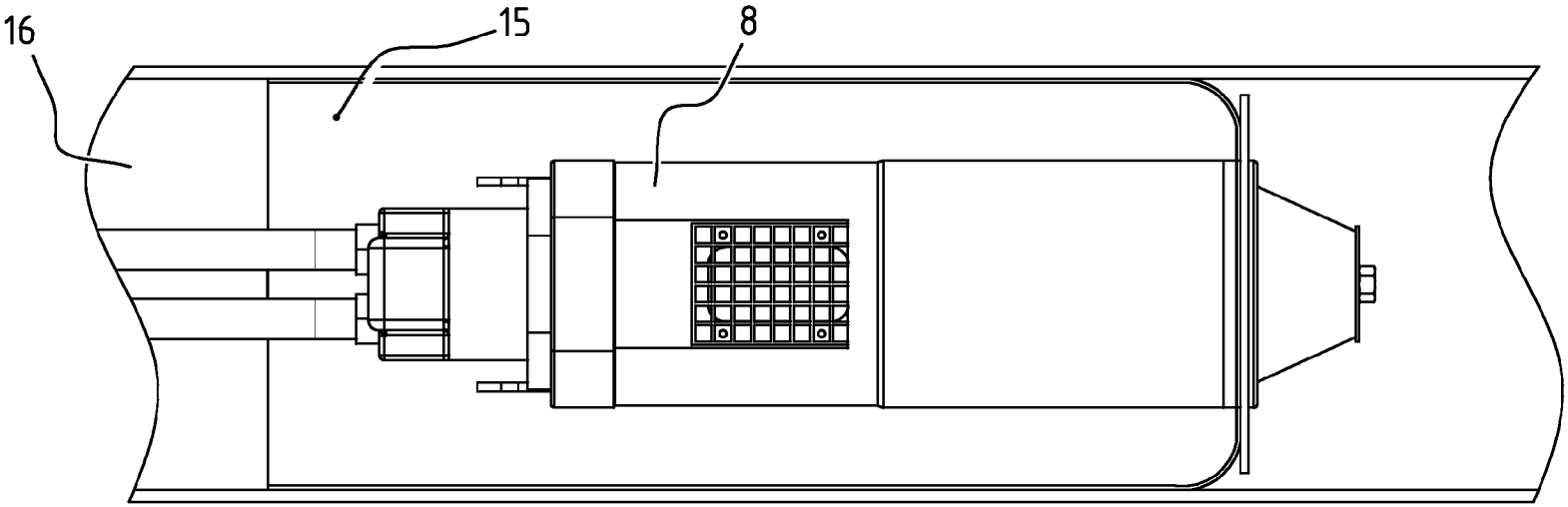
FIG. 5 shows a view of the pump of FIG. 2B with inner pipe seal.

Pump 8 (FIG. 5) can be provided with an inner pipe seal 15, also referred to as pump encasement seal, which surrounds the pump 8 and prevents leakage between the pump and a liquid conduit of suctioned fuel to the surrounding area through openings in the liquid conduit, such as a tube or pipe 16, in which pump 8 is placed. Tube or pipe 16 is preferably of the DN250 type. In the shown embodiment inner pipe 15 is of a plastic material such that it can be cut or severed to a suitable length, subject to for instance the length of tube 16. The plastic is for instance a plastic which can unfold or expand.

Figure 6:
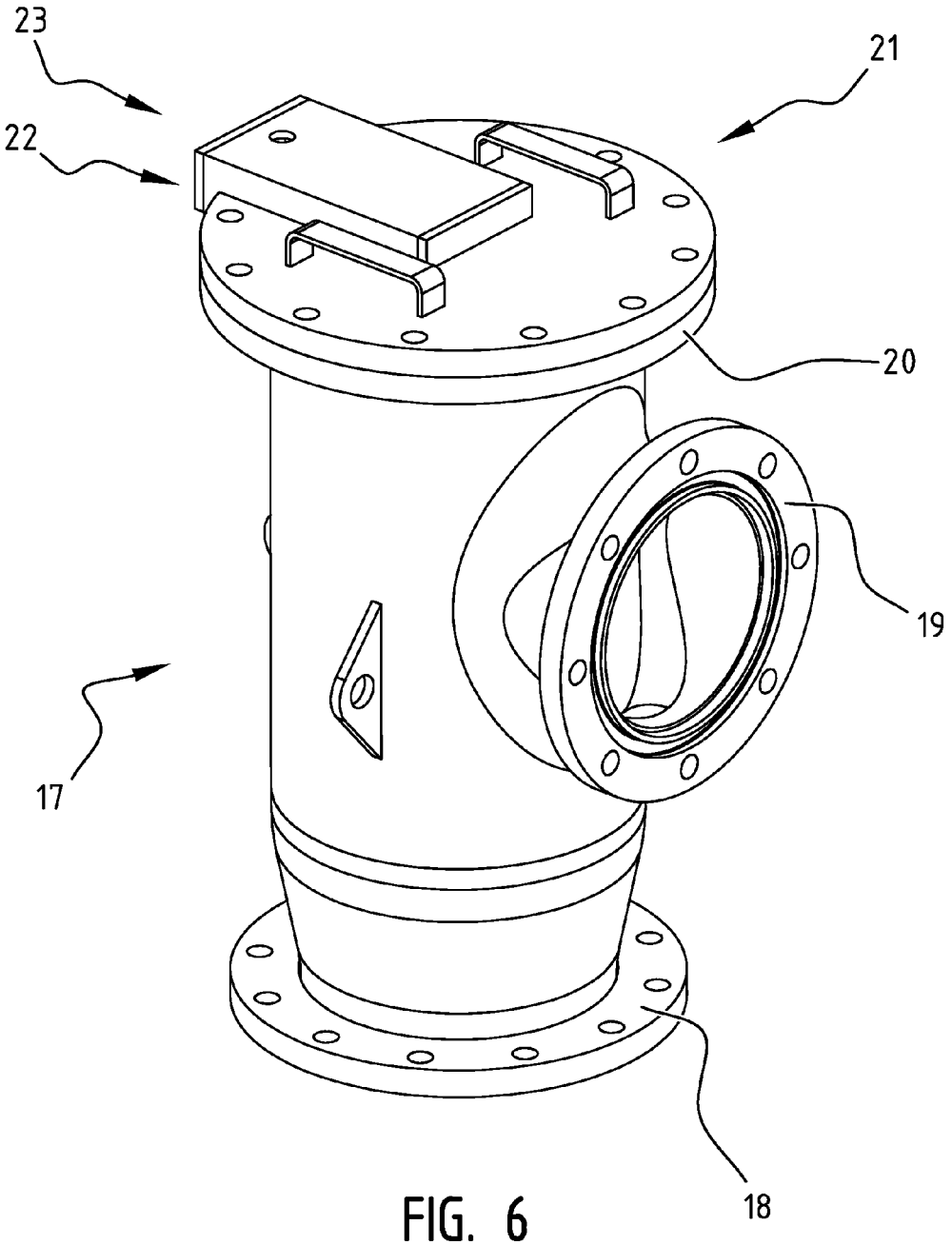
FIG. 6 shows a view of a T-piece for use in the pump system.

Pipe 16 is preferably provided with a T-piece 17 (FIG. 6). T-piece 17 is provided with a first flange 18 of DN200 on the feed side of the medium. A second flange 19 of DN200 is provided on the side for discharge of the medium, and a third flange 20 of DN300 is preferably provided with a cover 21. Arranged on or close to cover 21 are openings 22 with seals 23 for passage of hydraulic hoses 12.

Figure 7:
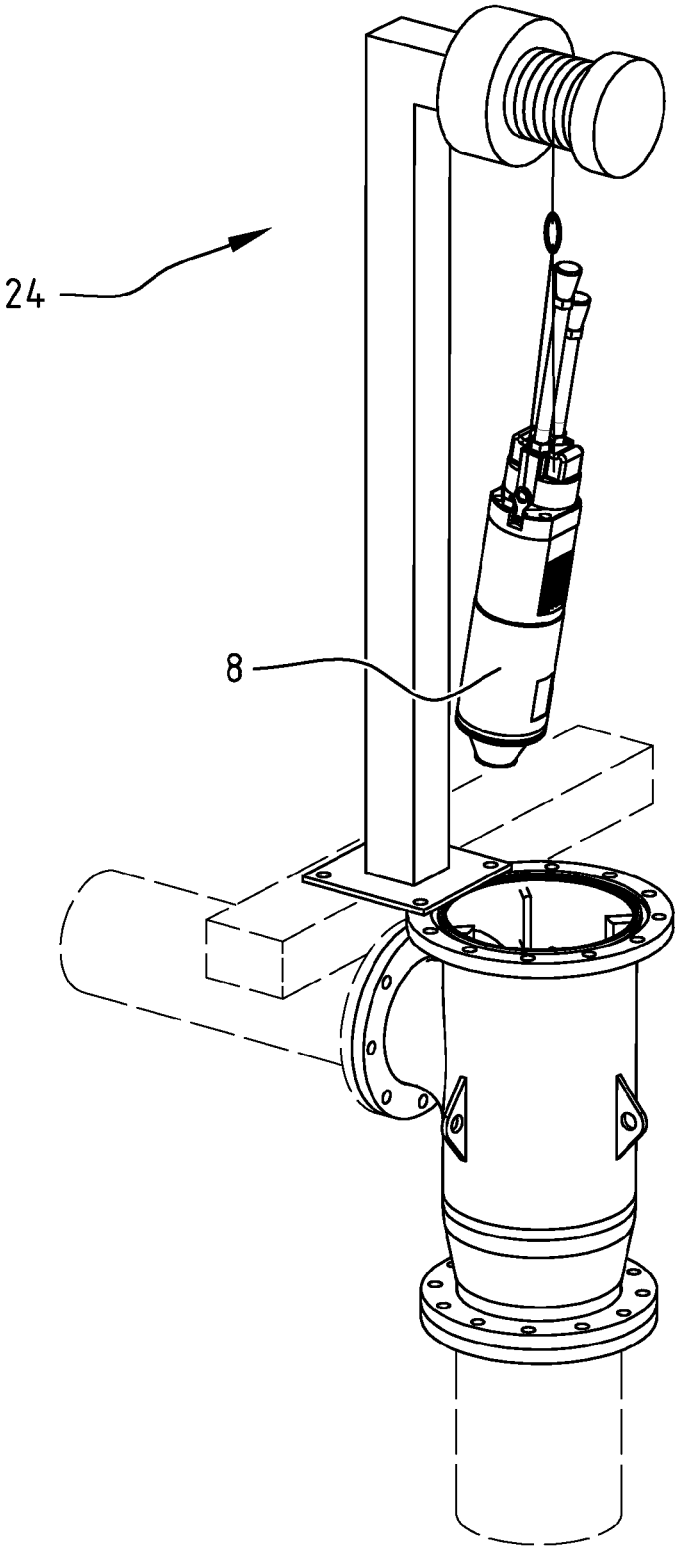
FIG. 7 shows a view of the pump of FIG. 2B being introduced into a pipe.
Figure 8:
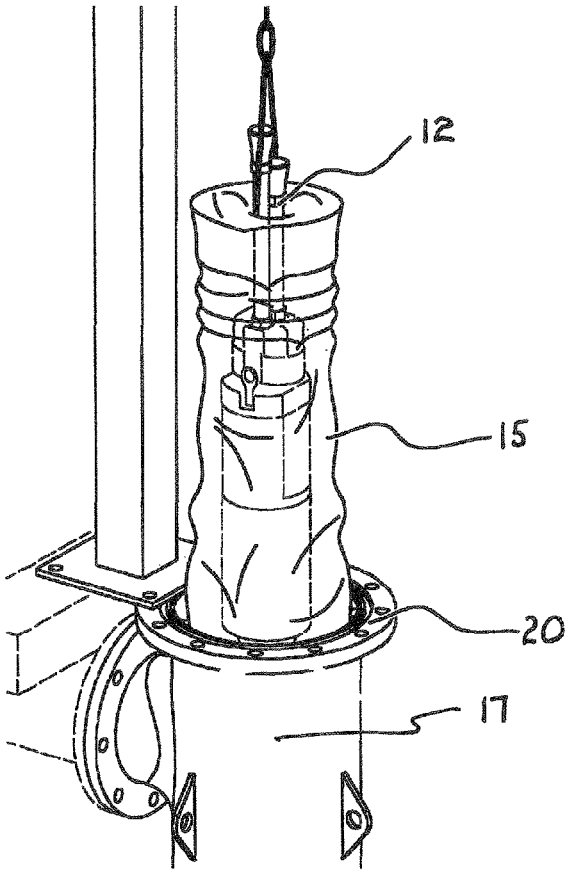
FIG. 8 shows a view of the inner pipe seal.
Figure 9:
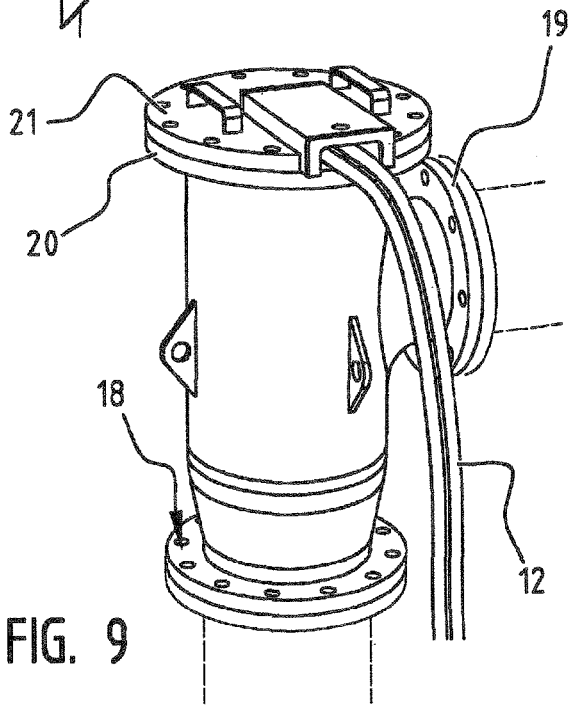
FIG. 9 shows a view of a T-piece.

Pump 8 can be placed in pipe 16 using a winch system 24 (FIG. 7). Other methods are also possible. Inner pipe 15 (FIG. 8) can be introduced via flange 20 into pipe 16 together with pump 8. Cover 21 (FIG. 9) is then provided for the purpose of sealing flange 20. In this configuration inner pipe 15 is suspended inside the T-piece, whereby the pump can later be pulled out of the T-piece again.

Tests have shown that the pump according to the invention has a pump capacity at different viscosities which is substantially constant over a wide operating range. A pump has thus been tested at different viscosities of 57.4 and 11.4 $mm^2/s$, at a temperature of respectively 36° C. and 20° C. and a pressure of about 3.0 bar, a rotation speed of 2600 rpm, a net positive suction head (NPSH) of respectively 5.9 and 4.8 mWC. The pump capacity at the different viscosities amounted to respectively 1189 and 1173.3 l/min. The power consumption in the comparative measurements amounted to respectively 13.0 and 9.9 kW. The pump capacity is therefore roughly constant at the different viscosities.

Further tests have shown that the pump capacity remains substantially constant at a difference in pressure in the range of at least 0-15 bar. Over this pressure range the variation in a capacity of 1200 l/min amounts to less than 100 l/min at the different viscosities.

Figure 10:
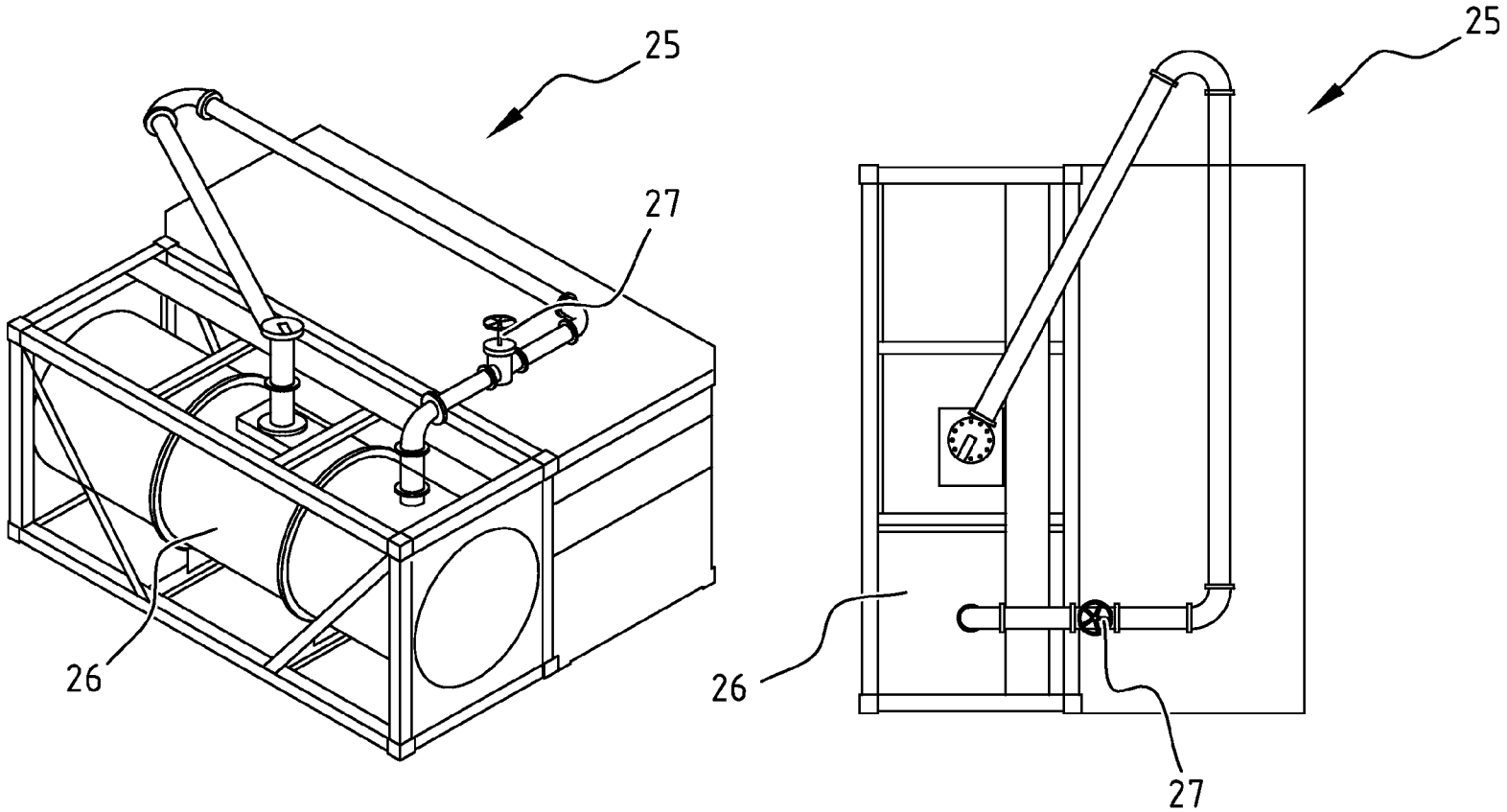
FIG. 10 shows a view of a test setup.

In tests with a test setup 25 (FIG. 10), wherein fuel from tank 26 can be pumped around via adjustable flow resistance 27, it has been found that pump 8 can be carried through differently shaped pipe parts of pipe 16.

Tests have shown that passage through a bend of a pipe with a 230 mm diameter is possible. This is likewise the case for a 45° S-bend at a pipe diameter of 184 mm and a 70° bend at a pipe diameter of 230 mm.

For the purpose of pumping a medium, a pump is introduced into a pipe which is connected to a fuel tank. This is for instance a fuel tank in a double-walled ship, wherein the fuel tank is provided between the two walls. The pump is placed in the pipe, preferably in combination with the inner pipe seal. This inner pipe prevents undesirable leakage of the pump fuel to the surrounding area. The pump is provided with a motor which in a currently preferred embodiment is driven hydraulically. The hydraulic hoses and the inner pipe seal are lowered into the pipe along with the pump. The pump suctions the fuel out of the tank and pumps it into the conduit. The conduit is preferably provided with a T-piece where the hydraulic hoses are carried out of the pipe and to which the outer end of the inner pipe is internally attached. The pumped medium is discharged via the other side. A fuel tank can in this way be pumped empty, and undesirable leakage is avoided.

Figure 11:
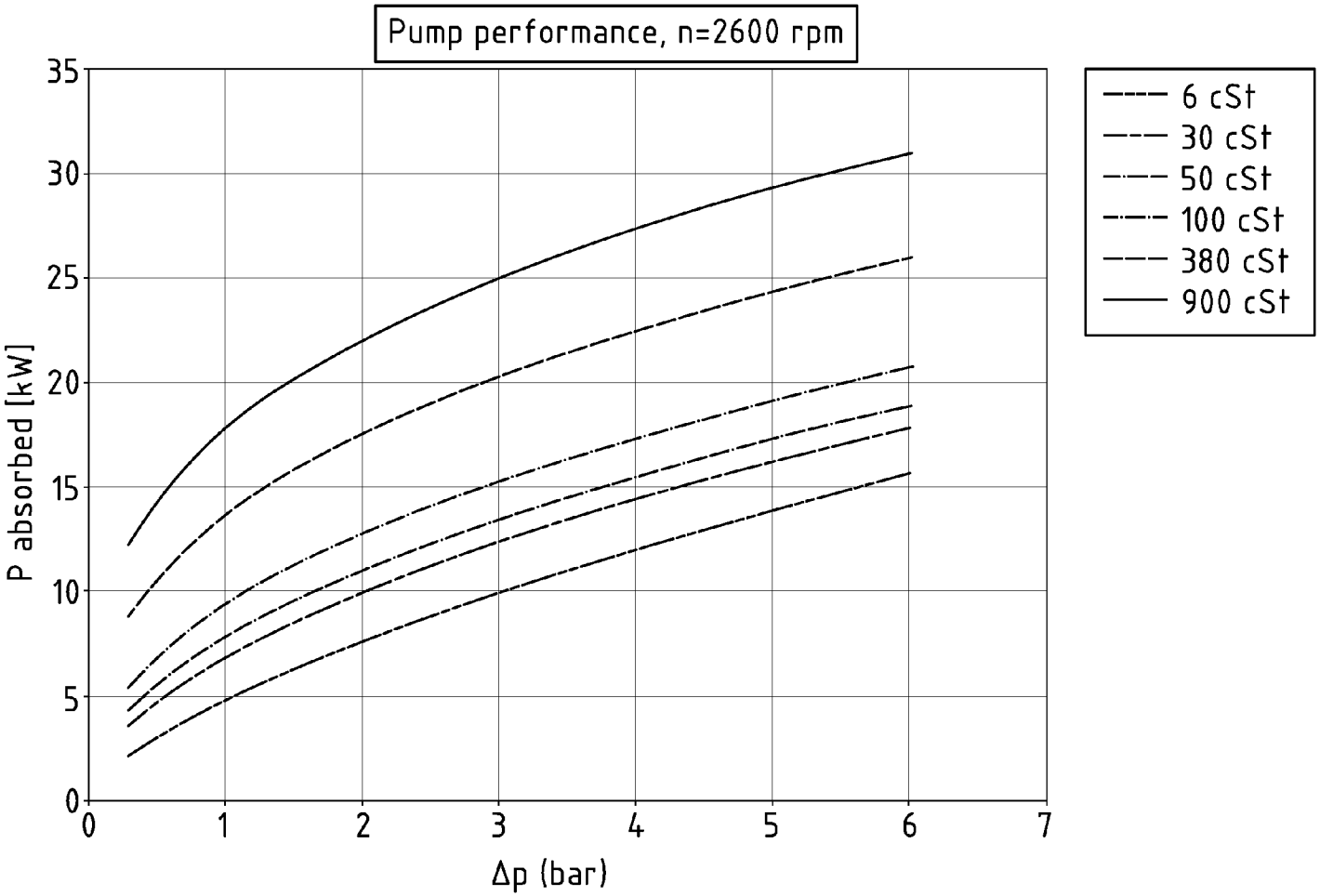
FIGS. 11-13 show results obtained with the pump according to the invention.
Figure 12:
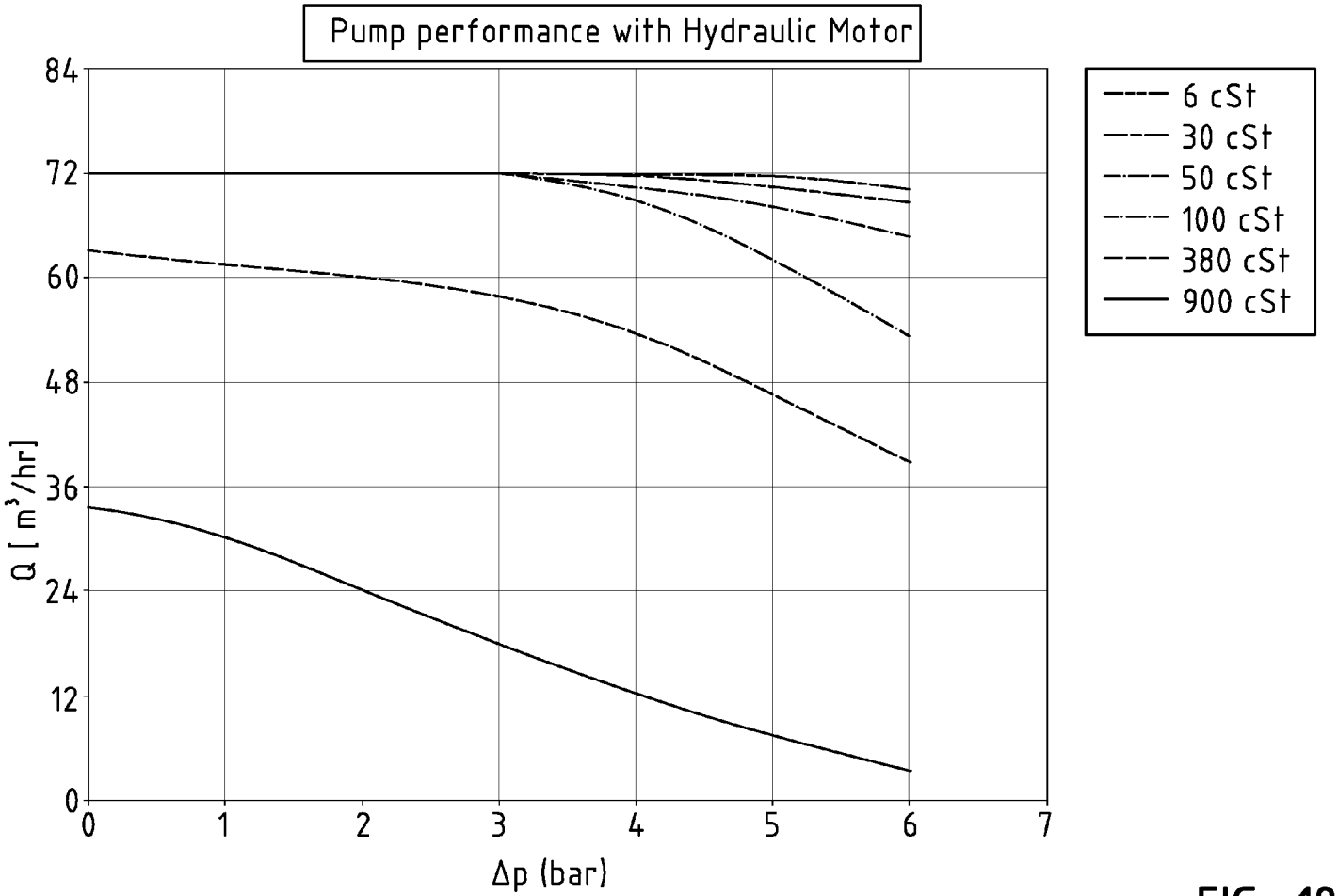
Figure 13:
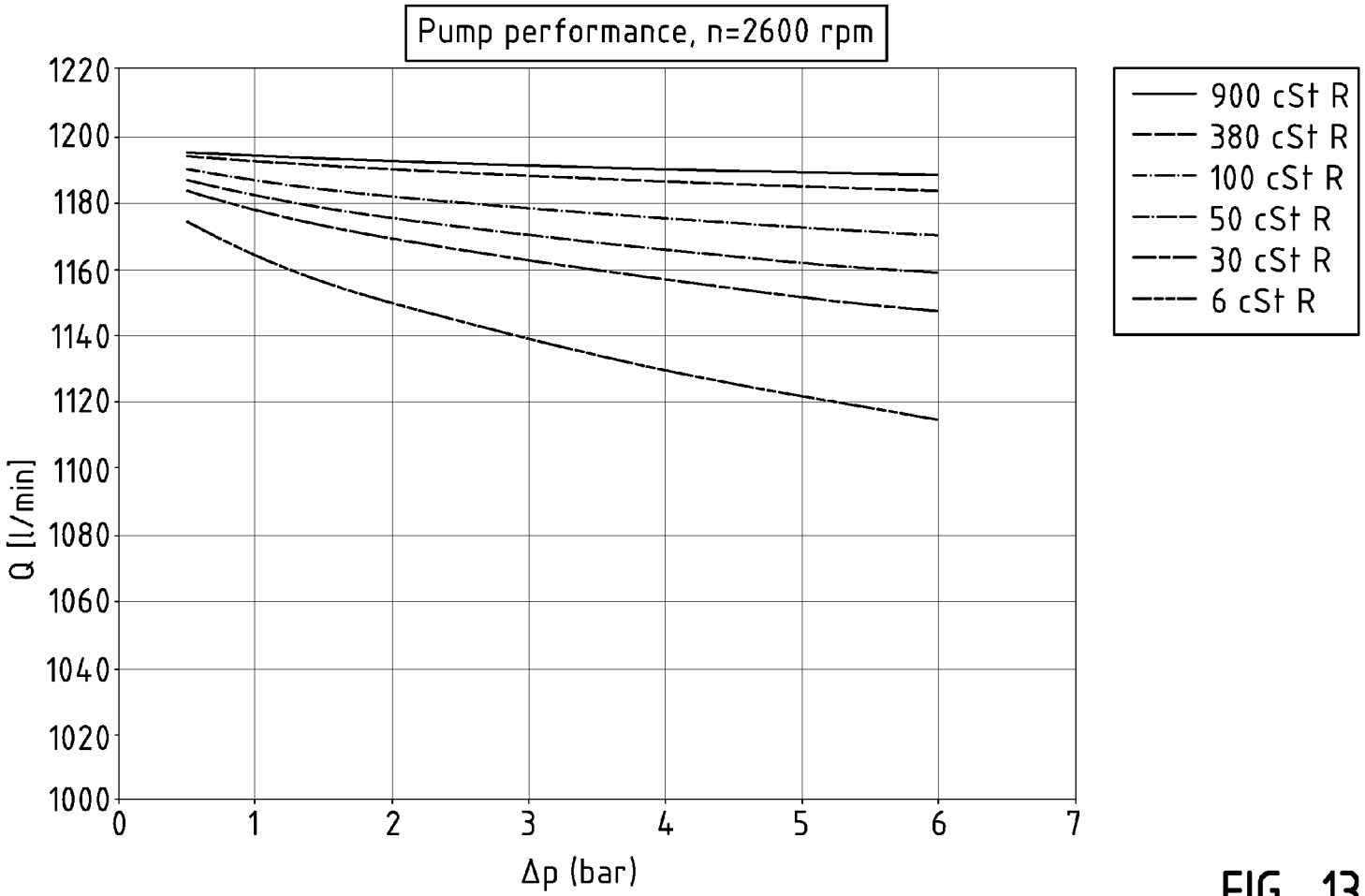

Further tests confirm the operation of the pump according to the invention. The pump has thus been tested over a pressure difference of 0-6 bar, at different viscosities of 6 cSt to 900 cSt at 2600 rpm (FIG. 11). The pump has further been tested with a so-called Eaton motor (FIG. 12) with flow rates up to 1200 l/min, i.e. 72 $m^3$/hour. In other tests, use has been made of a Leistritz pump. Further results (FIG. 13) show the above stated, substantially constant behaviour of the pump according to the invention. Said tests were performed with pump 1. With a different dimensioning and/or configuration of pump 1 it is also possible according to the invention to utilize pump 1 in other fields of operation.

The invention is by no means limited to the above described preferred embodiments thereof. The rights sought are defined by the following claims, within the scope of which many modifications can be envisaged. It is thus possible to also employ the pump as described above in other applications. It is thus for instance possible to envisage placing the pump according to the invention into an oil pipe, for instance in case of malfunction. Other applications according to the invention are also possible.

The invention claimed is:

1. A screw spindle pump for pumping fuel, oil and crude, comprising an inlet through which fuel is suctioned, an outlet, a drivable spindle and two follower spindles, wherein the drivable spindle and the two follower spindles are provided at a mutual angle to each other, and wherein the inlet is provided on a front side of the pump and the pump is provided on a rear side with a motor and wherein the angled relationship between the drivable spindle and the follower spindles allows the pump housing to be smaller than that of a conventional pump having a drive shaft and spindle shafts lying in one line, such that the screw spindle pump is adapted to be introduced into a liquid conduit for use as a submersible pump and wherein the pump further includes a pipe encasement seal which surrounds the pump and prevents leakage of suctioned fuel between the pump and the liquid conduit.

2. The screw spindle pump as claimed in claim 1, wherein the drivable spindle and the two follower spindles are provided in a visually asymmetrical configuration.

3. The screw spindle pump as claimed in claim 2, wherein the drivable spindle and the two follower spindles are provided in an asymmetrical force configuration.

4. The screw spindle pump as claimed in claim 1, wherein the screw spindle pump has an outer diameter in the range of 100-300 mm.

5. The screw spindle pump as claimed in claim 1, wherein the two follower spindles are provided with a smaller diameter than the drivable spindle.

6. A screw spindle pump system comprising a pump as claimed in claim 1.

7. A method for pumping a medium, comprising pumping the medium using the screw spindle pump as claimed in claim 1.

8. The method as claimed in claim 7, further comprising positioning the screw spindle pump in a space of a ship and pumping medium out of the ship.

9. The method according to claim 7, comprising introducing the screw spindle pump into the liquid conduit.

10. The method according to claim 9, wherein the liquid conduit comprises a monitoring pipe or ventilation pipe.

11. The screw spindle pump as claimed in claim 1, wherein the screw spindle pump has an outer diameter in the range of 100-200 mm.

12. The pump as claimed in claim 1, wherein the outer diameter of the screw spindle pump is 150 mm.

13. A method for pumping fuel, oil, or crude out of a ship, the method comprising pumping the fuel, oil, or crude using a screw spindle pump, comprising an inlet through which the fuel, oil, or crude is suctioned, an outlet, a drivable spindle and at least two follower spindles, wherein the drivable spindle and the at least two follower spindles are provided at a mutual angle to each other, and wherein the inlet is provided on a front side of the pump and the pump is provided on a rear side with a motor, further comprising introducing the screw spindle into a liquid conduit wherein the pump has an encasement seal which surrounds the pump to prevent leakage of suctioned fuel between the pump and the liquid conduit.

14. The method according to claim 13, wherein the liquid conduit comprises a monitoring pipe or ventilation pipe.

* * * * *